US006736237B2

(12) United States Patent
Shaw, Jr. et al.

(10) Patent No.: US 6,736,237 B2
(45) Date of Patent: May 18, 2004

(54) MUFFLER SOCK

(76) Inventors: Michael J. Shaw, Jr., 3 Proctor Rd., Newbury, NH (US) 03255; Lisa E. Shaw, 3 Proctor Rd., Newbury, NH (US) 03255

( * ) Notice: Subject to any disclaimer, the term of this patent is extended or adjusted under 35 U.S.C. 154(b) by 0 days.

(21) Appl. No.: 10/094,369

(22) Filed: Mar. 8, 2002

(65) Prior Publication Data

US 2003/0168279 A1 Sep. 11, 2003

(51) Int. Cl.[7] ..... F01N 7/08
(52) U.S. Cl. ..... 181/227
(58) Field of Search ..... 181/227, 212, 181/228, 217, 256, 232

(56) References Cited

U.S. PATENT DOCUMENTS 4,077,491 A * 3/1978 Hankel ..... 181/290
4,526,250 A * 7/1985 Messinger ..... 181/295
4,930,597 A * 6/1990 Udell ..... 181/256
6,284,201 B1 * 9/2001 Buck ..... 422/177

* cited by examiner

*Primary Examiner*—Kimberly Lockett
(74) *Attorney, Agent, or Firm*—Davis & Bujold, PLLC

(57) ABSTRACT

An exhaust stack cover sized to substantially conform and fit snugly, or elastically over the end and opening of the exhaust stack of a vehicle engine such that during transportation of the vehicle, wherein the engine is inoperative, a vacuum or air flow is prevented within the exhaust stack and thus the communicating turbine. Elimination of this vacuum and associated air flow prevents detrimental mechanical actuation of parts. Specifically the turbine shaft is protected, which is particularly susceptible to damage due to rotation without appropriate lubrication. The cover can be formed from a substantially heat resistant material such as neoprene which can withstand a substantial direct temperature by the exhaust stack as well as provide some elasticity in order to snugly and tightly grip the outside surface of the exhaust stack.

3 Claims, 4 Drawing Sheets

1
11
3
3
3
5
4
7
9
10
a

MUFFLER SOCK

FIELD OF THE INVENTION

The present invention relates to a cover for an engine exhaust stack of an engine, particularly to a heavy construction machinery vehicle engine, and more particularly to an exhaust cover for a machine having a turbo charged diesel powered engine. During vehicle transportation, the construction vehicle is generally carried or "piggybacked" by a separate vehicle for instance a tractor trailer. The construction vehicles' engine is turned off and the vehicles' exhaust stack, which is generally exposed to external air flow, is provided with a cover fit over the opening at the end of the exhaust stack to insure that no air flow develops within the exhaust stack during transportation of the heavy machinery.

BACKGROUND OF THE INVENTION

Heavy machinery, namely construction vehicles, for instance, loaders, diggers, bull dozers, etc., are usually delivered to a construction or work site piggybacked on either a flat bed of a tractor trailer combination or a flatbed railroad car. Modern heavy machinery construction type vehicles are driven by turbo charged diesel powered engines. Turbochargers compress the air flowing to the engine letting the engine squeeze more air into the cylinders, and thus more fuel can be added obtaining a greater explosion in each cylinder. A turbocharged engine produces more power overall than the same engine without turbocharging, which can significantly improve the power-to-weight ratio for the engine The turbocharger uses the exhaust flow from the engine to spin a turbine, which in turn spins an air pump. The turbine in the turbocharger spins at speeds of up to 150,000 rotations per minute (rpm) and because it communicates directly with the exhaust, the temperatures in the turbine are also very high. The turbine and pump utilize bearings which of course allows them to spin, and these bearings thus must be substantially continuously supplied with lubricant during operation of the vehicle.

In order to handle speeds of up to 150,000 rpm, the turbine shaft has to be supported very carefully. Most bearings would explode at speeds like this, so most turbochargers use a fluid bearing. This type of bearing supports the shaft on a thin layer of oil that is constantly pumped around the shaft. This serves two purposes: It cools the shaft and some of the other turbocharger parts, and it allows the shaft to spin without much friction.

While being transported to and from construction sites by a separate vehicle, the heavy construction vehicle is inoperative, i.e. the engines in most cases being completely shut down. During such transportation, the machinery is subjected to air flow passing around the exhaust stack which generally extends up above the vehicle. This external air flow can create a vacuum down through the exhaust stack, and into the turbocharger, which as discussed above, is connected with the exhaust. When such a vacuum develops through the exhaust and turbocharger the turbine and pump may be caused to spin. As is apparent to those of skill in the art, without the engine operating no oil or lubricant is supplied to the turbine and pump and thus significant wear and failure of the turbocharger may result. It is therefore well known in the art of the necessity to cover the opening of the exhaust stack to eliminate any vacuum or air flow created by the transportation of the heavy machinery while the engine is shut down.

In order to overcome the above described problem it is quite common for transporting drivers and/or construction machinery operators to cover the opening of the exhaust stacks with tape, in particular heavy masking tape or duct tape for instance. While this tape can be appropriate in limited circumstances, over a period of time exposure to the elements and wind resistance forces created during transport, the tape can wear through and disintegrate and thus fail to properly protect the turbine. Furthermore, in the instance of covering the exhaust stack opening with tape, due to the high exhaust temperatures, which can reach several hundred degrees Fahrenheit, failing to remove the tape can cause the tape to burn and permanently adhere the tape remnants and adhesive to the exhaust stack where the heavy machinery is run without appropriately removing all the tape and adhesive before operation.

OBJECT AND SUMMARY OF THE INVENTION

It is an object of the present invention to provide protection for a turbocharger of a vehicle by covering and enclosing the open end of the exhaust stack of a muffler with an exhaust stack cover.

It is a further object of the present invention to provide an exhaust stack cover which fits elastically over the end of the exhaust stack to withstand weather and wind resistance forces and which can not easily be removed from the exhaust stack by such forces.

It is a further object of the invention to provide a reusable and replaceable cover which can withstand against substantial material degradation due to significant heat generated by the exhaust stacks when placed on an exhaust stack of a vehicle that has only been recently shut off.

It is a further object of the invention to provide a cost effective and easily manufactured cover which can be simply stored inside the cab of a vehicle and used whenever necessary and which can be cheaply replaced in case of destruction or loss.

The exhaust stack cover of the present invention is sized to substantially conform and fit snugly, or elastically over the end and opening of the exhaust stack of a vehicle engine such that during transportation of the vehicle, wherein the engine is inoperative, a vacuum or air flow is prevented within the exhaust stack and thus the communicating turbine. Elimination of this vacuum and associated air flow prevents detrimental mechanical actuation of parts. Specifically the turbine shaft is protected, which is particularly susceptible to damage due to rotation without appropriate lubrication.

The muffler cover can be formed from a substantially heat resistant material such as neoprene which can withstand a substantial direct temperature by the exhaust stack as well as provide some elasticity in order to snugly and tightly grip the outside surface of the exhaust stack. The exhaust stack cover can usually be formed from a single piece of material folded over and sewn along an edge in any shape, and leaving an opening, or can be formed from two pieces of material, also sewn along the edges leaving an opening. The cover can even be formed from a tubular formed sleeve or any other base material as is known in the art to cover a particular shape or profile of exhaust stack and opening.

DETAILED DESCRIPTION OF THE INVENTION

Figure 1:
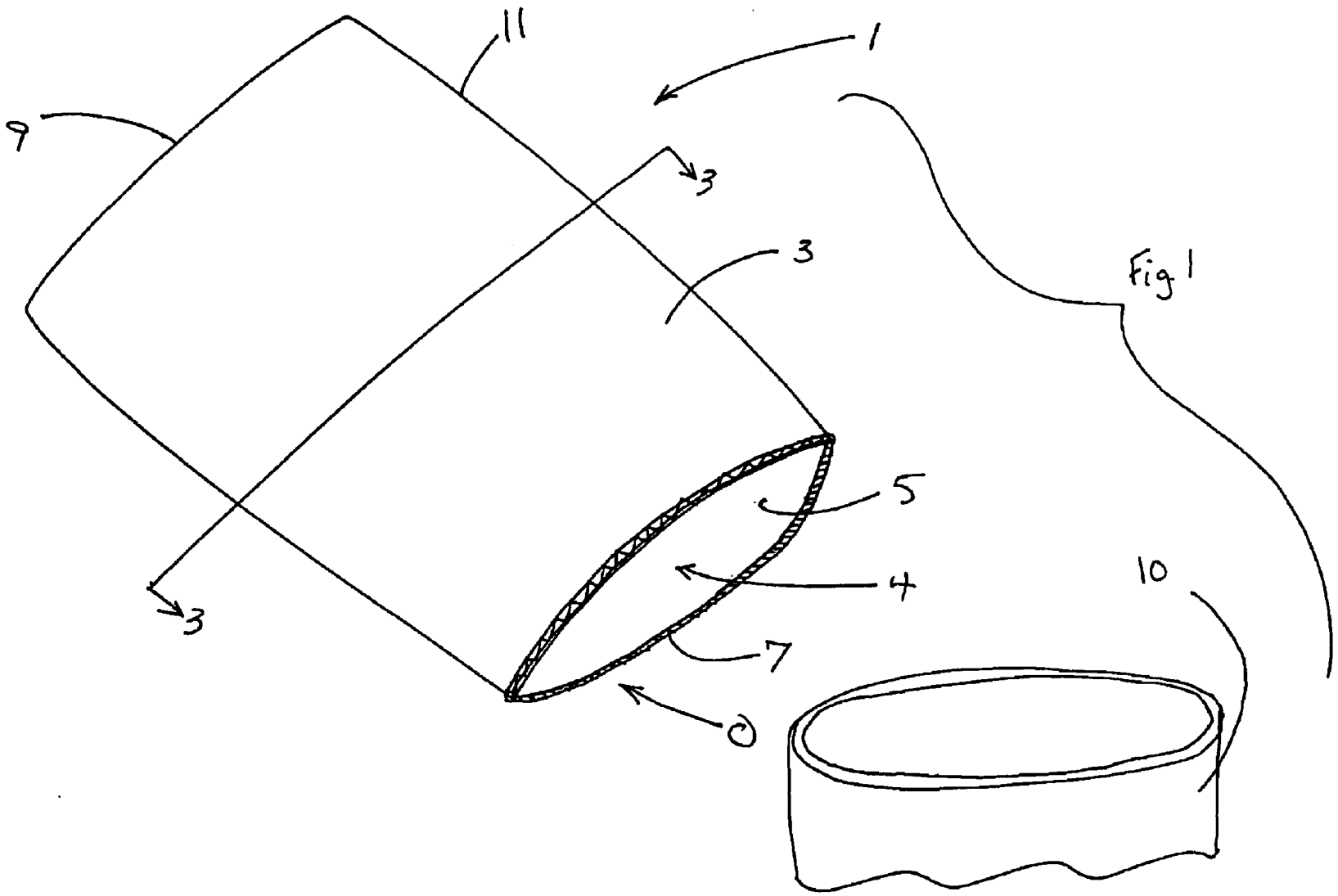
FIG. 1 is a perspective view of one embodiment of the exhaust stack cover showing the sewn opening edge defining the opening.

Observing FIG. 1, the exhaust stack sock or exhaust stack cover 1 is shown formed from a material 3 defining an inner cavity 4 into which the exhaust stack is inserted through an opening O as defined by a sewn rim 7. In this embodiment where a single piece of relatively flexible material, for example neoprene, is used to form the cover 1, the material 3 is generally folded over on itself and sewn along a top edge portion 9 and a side portion 11 to form the substantially enclosed exhaust stack cover 1.

The opening O is defined by the sewn rim 7 which facilitates the insertion of the exhaust stack 10 within the cover 1. The sewn rim 7 may be sewn in any manner as is known in the art but in particular may be sewn with a particular stitch method or machine utilizing what is known in the art as a serger, overlock, overcast or merrow stitch. This type of edge stitching provides for a substantially completely sewn rim 7 having no overlap or hem and which substantially seals the exposed material defining the rim 7 of the cover 1.

The cover 1 may be formed as discussed above from a single homogeneous piece of material. In other embodiments, the cover may be formed from a layered material to provide for instance for a different outer material 3 and inner material 5. Before being formed into the cover 1, the cover 1 may have the outer material 3 attached to the inner material 5 for instance by gluing or other method as is known in the art. In one embodiment the inner material 5 is generally a neoprene or similar rubbery material as is known in the art which has a frictional, semi-adhesive type surface which can directly contact and grip the metal surface of the exhaust stack 10, as well as withstand certain high temperatures. The outer material 3 may be a different material such as a sewn flexible cloth type covering glued or affixed to protect the inner material 5 like a neoprene and to provide a more aesthetic appearance.

Figure 3:
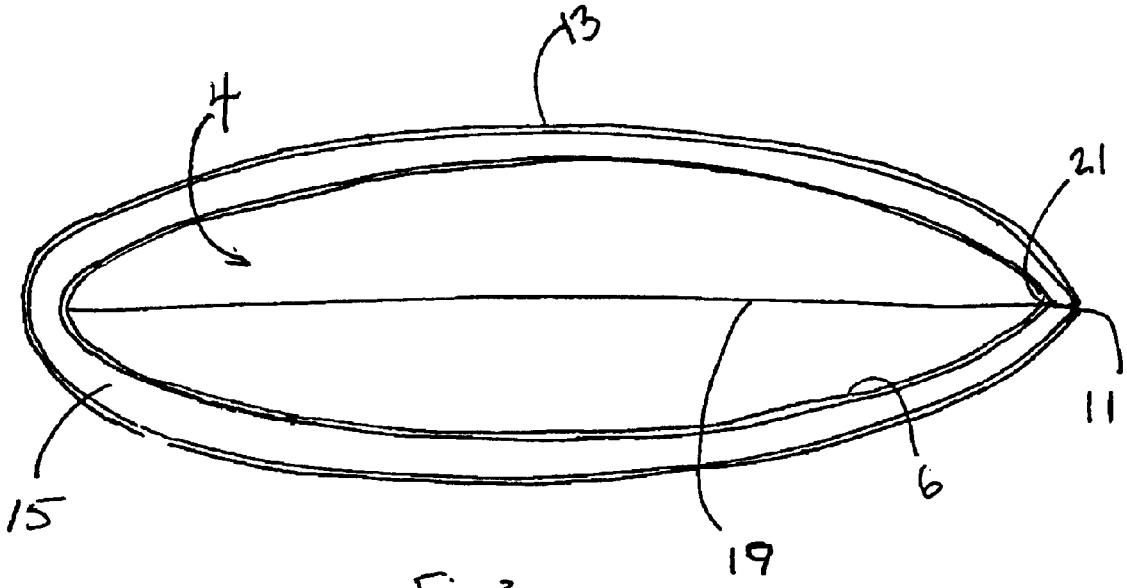
FIG. 3 is a cross-section of the muffler cover along line 3—3 of FIG. 1 detailing the inside cavity of the cover.

It is to be appreciated by those of skill in the art that any number of layers of different material may be used to form the cover 1. In another embodiment the cover 1 may consist of more than the above described one or two different layers of materials. For example, besides the inner material 5 and outer material 3, a protective material 6 as shown in FIG. 3 may be provided as a contacting layer on an inner surface of the inner material 5. The protective material 6 can be made from any protective type material known in the art and is designed to be interposed between the inner material 5 and the metal surface of the exhaust stack 10, thus protecting the inner material 5 from direct contact with the exhaust stack and any direct heat or debilitating effects thereof on the inner material. As such layering of different type materials is well known in the art no further discussion is provided.

The material forming the cover 1 is provided with a desired thickness which can be in the range of about 0.5–10 mm, more often within about 2–7 mm and most preferably in the range of 3–6 mm. Where the inner material 5 is a neoprene which is most readily available in about 3–5 mm thicknesses, the range of 3–6 mm is preferable since the outer layer 3 is generally of a lesser thickness than the inner material 5 and any protective material 6 is also generally of a lesser thickness as well.

It is well known in the art that exhaust stacks 10 may be formed in any number of configurations, some are straight, having an opening facing substantially vertically skyward, i.e. a plane defined by opening is substantially parallel to the ground, or certain exhaust stacks 10 may have the end being curved or angled and having an substantially horizontally aligned opening, i.e. the opening is defined by a plane substantially perpendicular to the ground, to ensure that elements such as rain, snow and falling construction debris etc. do not enter directly into the exhaust stack 10. As such conventional exhaust stack features are well known in the art no further discussion with respect to exhaust pipes is provided herein.

Figure 2A:
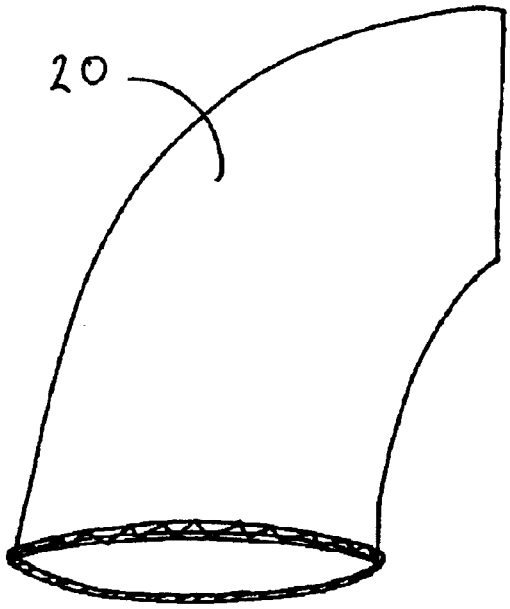
FIGS. 2A and 2B detail alternative embodiments indicating a differently shaped exhaust stack cover.
Figure 2B:
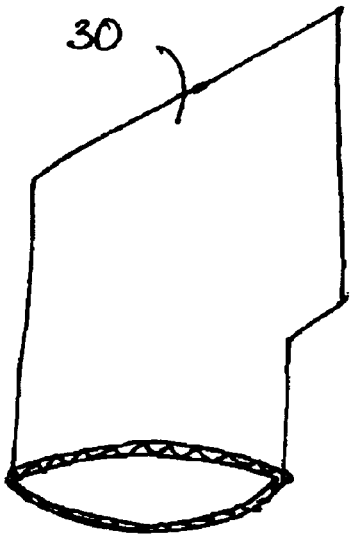

Turning to FIG. 2*a*, and with respect to the different shapes of exhaust stacks 10 as discussed above a number of different embodiments of the present invention can easily be appreciated by those in the art. The cover 20 is formed defining a curve in order to accommodate a curved type exhaust stack. FIG. 2*b* shows an angled exhaust stack cover 30 having more distinct and sharper corners in order to fit over a more angled and linear profile of exhaust stack 10.

It is to be noted that any number of shapes may be contemplated as there are exhaust stack ends and profiles. Furthermore the diameter of most any exhaust stack which generally range from about one to twelve inches as is known in the art can be accommodated by an appropriately sized cover 1. It is also to be noted that the neoprene or rubber type material is highly flexible and although it may fold flat in storage, it can assume almost any shape or profile within the bounds of the materials elasticity. In the case of an exhaust stack 10 which is in general a round, tubular pipe defining the opening at the end thereof, the cover 1 can easily conform and cover such a shape where the cover has been sized appropriately.

Figure 4B:
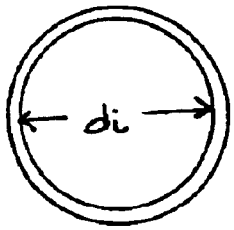
FIG. 4B is a cross-sectional view of the cover showing an inner diameter thereof.

Turning now to FIG. 3 the muffler cover 1 is shown in cross section having a layer of neoprene 15 and an outer layer of protective material 13. The inner layer of neoprene 15 constitutes the inner material 5 which provides for an inner diameter which is substantially the same or even slightly less than an outer most diameter of an exhaust stack. This feature will be thoroughly discussed with respect to FIGS. 4A and 4B. Thus, in the case of such an appropriately sized cover 1, a slight elastic deformation of the neoprene layer 15 and the outer layer of protective material 13 can provide for circumferential gripping force when the exhaust stack cover 1 is drawn or pulled over the end of the exhaust stack 10. Where the first layer 15 of neoprene constitutes the inner material 5, the outer layer 13 can be of a different stretchable and thinner material such as a flexible elastic nylon cotton mix, although it is conceivable that a number of other materials known in the art could be used as well.

Viewing directly into the cavity 4 of the exhaust stack cover 1, an inner portion 19 of the top seam 9 can be seen running the width of the cover 1, and an inner portion 21 of the side seam 11. These edges and seams may be sewn in a method as is well known in the art utilizing the above described stitch techniques or others as are known in the art. In the present embodiment which utilizes a single piece of layered material folded over on itself, a minimum of seams, i.e. the top seam 9 and side seam 11 are created. Such construction simplifies the manufacturing process and eliminates other seams which could potentially fail.

As is apparent to anyone of ordinary skill in the art this article could be manufactured from any number of differently shaped pieces and sizes of material, however for ease of manufacture, efficiency and economics dictate that in most cases a single piece is generally utilized. Furthermore slight modifications to the cutting of the material would allow for exhaust stack covers such as shown in FIGS. 2*a* and 2*b*, or other shapes, to be cut from a single piece of material as well.

Figure 4A:
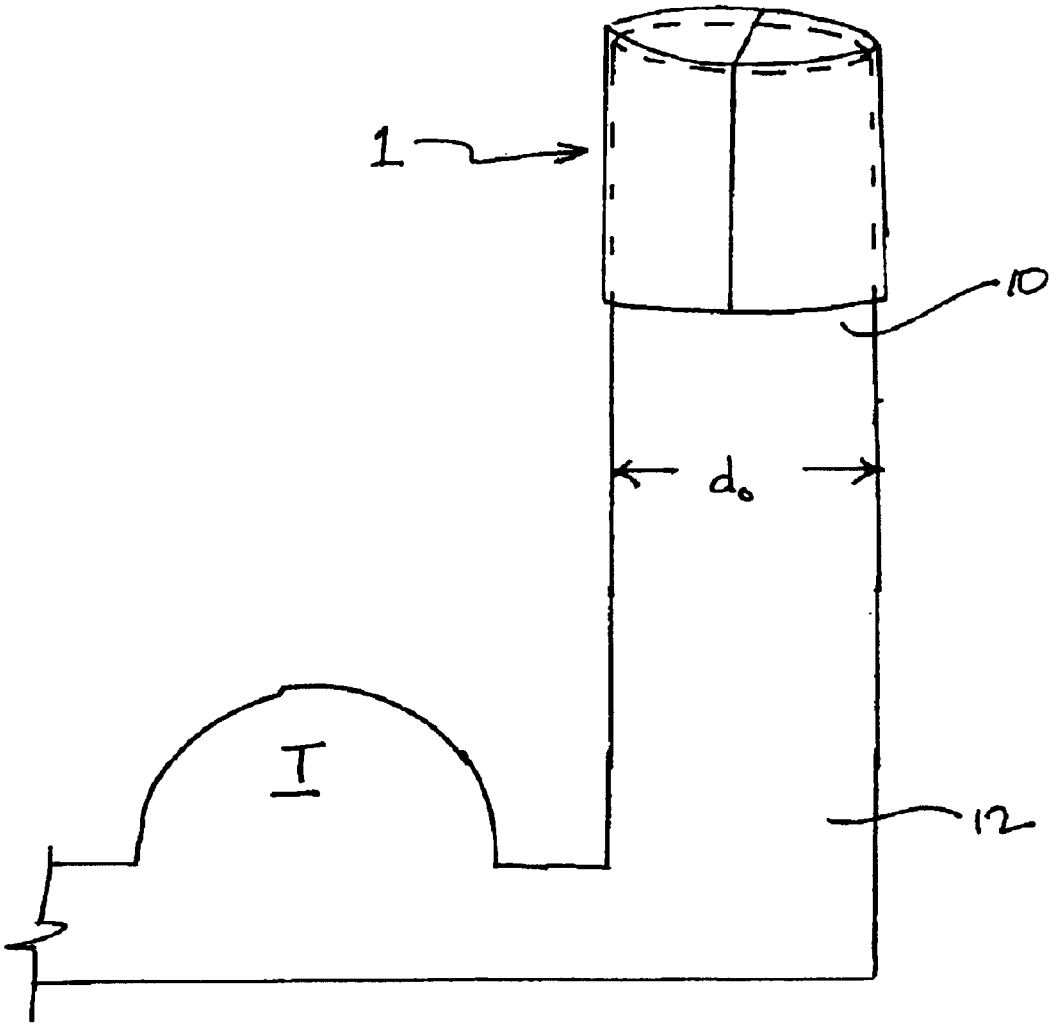
FIG. 4A details a perspective view of the exhaust stack in combination with the stack cover.

Turning to FIG. 4A a description of the present invention as utilized in combination with the end of the exhaust stack 10 is now provided. The exhaust stack 10 as described above communicates with the turbine T via an exhaust passageway 12 through which exhaust gases are exhausted from the engine of the vehicle. This passageway 12, can also allow a detrimental back flow of air caused by the vacuum if the exhaust stack 10 is left uncovered during transportation.

In order to stop any back flow of air created by the vacuum from spinning the turbine T, with the construction vehicle engine turned off, the exhaust stack cover 1 is manipulated by the vehicle driver or operator aligning the opening O with the top of the end of the exhaust stack 10 and pulling the cover 1 over the end of the exhaust stack 10. In a preferred embodiment of the invention, the cover 1 is provided with an inner diameter $d_i$, shown in FIG. 4B, being essentially the same size as an outer diameter $d_o$ of the exhaust stack 10 or slightly smaller, thereby creating a gripping force applied circumferentially by the exhaust cover 1 around the end of the exhaust stack 10 to hold it in place with respect thereto.

The difference between $d_i$ and $d_o$ should be adequate to provide sufficient circumferential gripping force to ensure that even during transportation of the construction vehicle, and the associated with wind resistance, the cover 1 is not removed or blown off from the exhaust stack 10. When the vehicle is ready for transportation, the driver and/or operator ensures that the exhaust stack cover is pulled substantially over the top of the exhaust stack and is of sufficient size as described above to remain thereon during transportation of the heavy machinery vehicle. It is also to be appreciated that the cover 1 could be provided with a grommet or other similar attachment device which would allow for a cord, line or rope which could be used to tie the cover in place as well. As such supplemental fastening devices would be apparent to one of skill in the art, no further discussion is provided.

Upon reaching the desired destination i.e. a work site where construction type work is to be performed, before operation of the vehicle, generally when the construction vehicle is started up to be removed from the carrier vehicle, the operator removes the cover by either rolling the rim 7 upwards or working the cover 1 up off the exhaust stack 10 such that the cover 1 is now removed and the exhaust stack 10 and passageway 12 are now free to allow the exhaust gasses and fumes to be passed from the engine and out of the exhaust stack 10 of the vehicle during operation. While the construction vehicle is in use at a work site, the cover 1 having been removed from the exhaust stack 10, may be tossed in the cab of the construction vehicle or behind the operator's seat and due to its compressibility takes up little space and requires no special care.

Without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A cover for an exhaust stack of an engine having a turbocharger communicating with the exhaust stack, the cover comprising:

a single piece of primary material having a first and second opposing side edges and an opposing top and bottom edges;

a first seam defined by the first and second opposing side edges being sewn together along their lengths;

a second seam defined by a first overlapping portion of one of the top and bottom edges being sewn to a second respective overlapping portion of the same top or bottom edge;

an opening defined by a rim formed by a remaining unsewn overlapping portions of one of the top and bottom edges;

a cylinder once the opposing side edges of the single piece of primary material are sewn together as the first seam and a cavity defined by the cylinder, the opening and the second seam created by the first overlapping portion of one of the top and bottom edges being sewn to the second respective overlapping portion of the same top or bottom edge; and a secondary material affixed to one side of the primary material to provide protection to an outer surface of the cylinder.

2. The cover for an exhaust stack as set forth in claim 1 further comprising a protective layer disposed on an innermost surface of the primary material, the protective layer providing an insulated spacing between the primary material and an outer surface of the exhaust stack to protect the primary material from direct contact with the exhaust stack.

3. The cover for an exhaust stack as set forth in claim 1 further comprising at least a layered first and second material forming the primary material wherein one of the first and second materials is neoprene and the cylinder as defined by the sewn first and second side edges has an inner diameter substantially the same as an outer diameter of the exhaust stack of the vehicle to provide a snug engagement therebetween.

* * * * *